US005735182A

United States Patent [19]

Wild

[11] Patent Number: 5,735,182

[45] Date of Patent: Apr. 7, 1998

[54] APPARATUS FOR ASSEMBLING THREADED CONNECTORS

[75] Inventor: Ronald Lee Wild, Carmel, Ind.

[73] Assignee: Lucent Technologies Inc., Murray Hill, N.J.

[21] Appl. No.: 533,046

[22] Filed: Sep. 25, 1995

[51] Int. Cl.[6] ..... B25B 17/00

[52] U.S. Cl. ..... 81/57.3; 81/424.5

[58] Field of Search ..... 81/54, 57.17, 57.3, 81/57.2, 57.43, 424.5

[56] References Cited

U.S. PATENT DOCUMENTS 4,436,003 3/1984 Cox ..... 81/57.43
5,351,582 10/1994 Snyder et al. ..... 81/57.17

*Primary Examiner*—James G. Smith
*Attorney, Agent, or Firm*—Christopher N. Malvone

[57] ABSTRACT

An apparatus assembles threaded parts in a cramped space. The apparatus grasps a nut so that an axial force may be placed on the nut while it is being threaded. The apparatus also provides a mechanism for rotating the nut in a relatively low torque fashion that permits a user to feel a cross-threaded orientation.

10 Claims, 2 Drawing Sheets

APPARATUS FOR ASSEMBLING THREADED CONNECTORS

BACKGROUND OF THE INVENTION

1. Field of the Invention

The present invention relates to threaded connectors; more particularly, to an apparatus for assembling a threaded connector in a restricted space.

2. Description of the Related Art

In the past, it was extremely difficult to assemble a threaded connector in a cramped space. For instance, if there was insufficient space for an operator's fingers to thread a nut onto a bolt, the operation had to be performed with a tool such as a wrench. Using a tool such as a wrench had many problems. For example, it is desirable to place an axial force on a nut when threading the nut onto a bolt; however, placing an axial force on the nut resulted in the nut slipping out of the wrench's grip. In addition, using a wrench to start the nut was prone to cross-threading. The wrench produced a large amount of leverage while starting the nut so that it was difficult for a user to feel the higher torque which typically indicates a nut is starting to cross-thread.

SUMMARY OF THE INVENTION

The present invention provides an apparatus for assembling threaded connectors or parts in a cramped space. The apparatus solves the above mentioned problems by firmly grasping a threaded part, such as a nut, so that an axial force may be placed on the nut while it is being threaded. The apparatus also provides a mechanism for rotating the nut in a relatively low torque fashion so that a user can feel the higher torque which is indicative of a cross-threaded orientation.

An embodiment of the present invention comprises a pliers with TEFLON resin coated jaws and rotatable drive rollers. (TEFLON is a trademark of E. I. DuPont De Nemours and Company for a polytetrafluoroethylene resin.) The TEFLON resin coated jaws and drive rollers grasp the nut so that an axial force may be placed on the nut while it is being threaded onto a receiving bolt or machine threaded stud. The drive rollers are rotated using a planetary gear assembly. The rotating drive rollers cause the nut to rotate so as to thread the nut onto the receiving bolt. The apparatus may then be used to continue to rotate the nut until it is ready to be tightened by a conventional wrench.

DETAILED DESCRIPTION OF THE INVENTION

Figure 1:
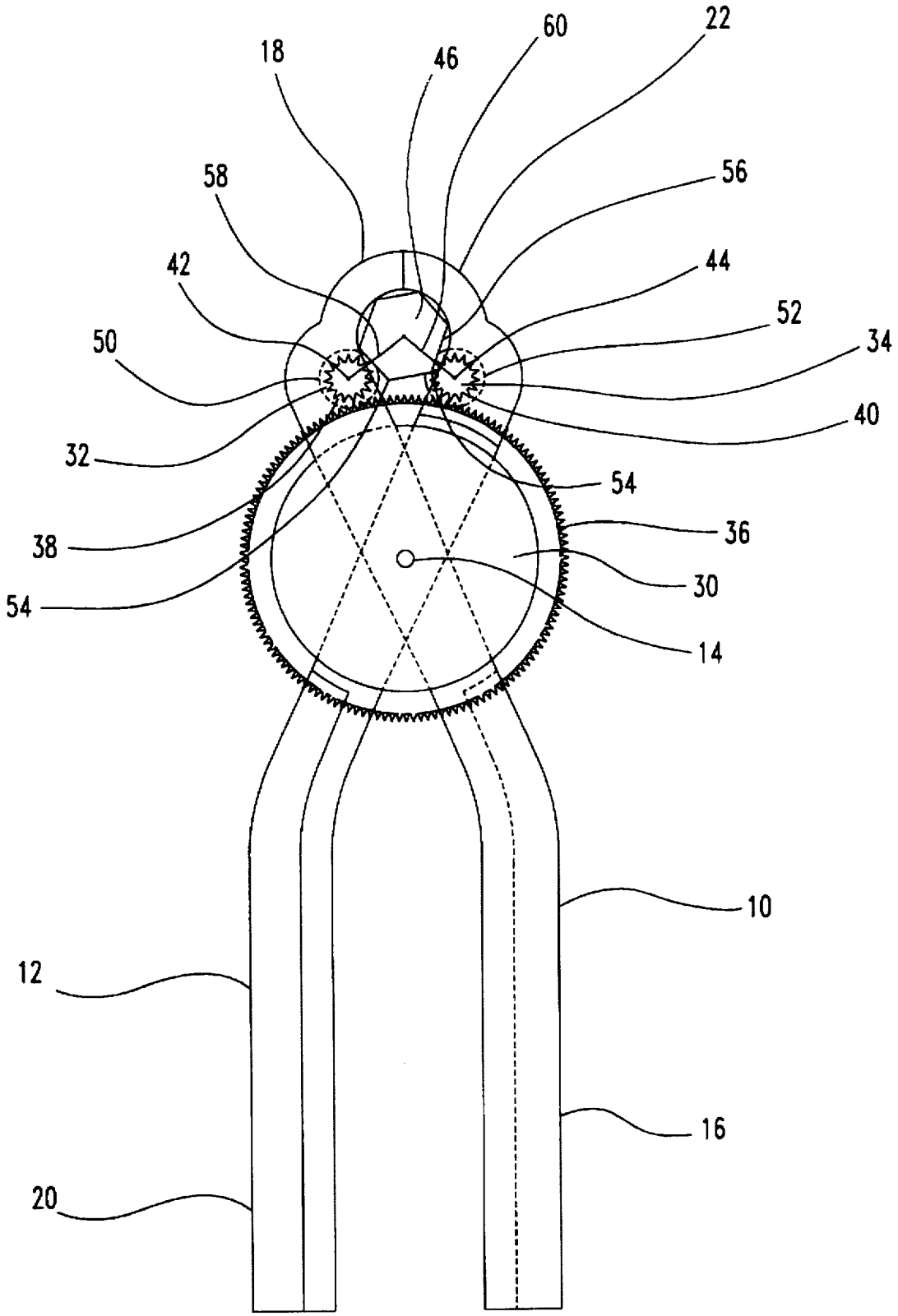
FIG. 1 illustrates a pliers with a planetary gear assembly.

FIG. 1 illustrates a top view of an embodiment of the present invention. Lever Arms 10 and 12 are pivotally connected at pin 14. Arm 10 includes handle end 16 and jaw end 18. Likewise, arm 12 includes handle end 20 and jaw end 22. The arms pivot about pin 14 so that when handles 20 and 16 are separated, jaws 22 and 18 separate, and when handles 20 and 16 are pressed toward each other, jaws 18 and 22 close. The levers may be fabricated with plastic or metal with low friction inserts in the jaws.

Gears 30, 32, and 34 form a planetary gear system. Gear 30 is rotatably mounted to pin 14. The outer perimeter of gear 30 has teeth 36 that interact with teeth 38 of gear 32 and teeth 40 of gear 34. It is also possible to use toothless or friction gears that interact using high friction surfaces such as rubber. When gear 30 is rotated, gears 32 and 34 rotate about pins 42 and 44, respectively. Pins 42 and 44 mount gears 32 and 34, respectively, to the jaw end of their associated arms. It should be noted that when gear 30 is rotated in a clockwise direction, gears 32 and 34 rotate in a counterclockwise direction which results in nut or threaded part 46 rotating in a clockwise direction. Likewise, when gear 30 is rotated in a counterclockwise direction, gears 32 and 34 rotate in a clockwise direction which results in nut or threaded part 46 rotating in a counterclockwise direction. This arrangement results in nut 46 being rotated in the same direction as gear 30 so that the operation of the apparatus is less confusing to the user. A gear ratio, such as 5.5:1, may be used so that an operator can feel cross-threading occurrences.

The gears can be made using plastic or metal where plastic offers the advantage of being light while metal offers the advantage of being durable.

Mounted to gears 32 and 34 are drive rollers 50 and 52, respectively. The rollers are attached to the gears so that they rotate with their respective gears. The rollers are formed using a compliant material such as a silicon rubber coated sponge rubber material and may be attached to the gears using a pressed fit by pressing the roller onto a mutual axle that has barbs at roller and gear locations to inhibit relative rotation. The gear/roller/axle assembly rotates freely relative to the bearings formed by the lever arms 10 and 12. The rollers are located so that when the jaws 18 and 22 are closed about nut 46, the sponge rubber portion of the rolls are compressed against the sides of nut 46. It should be noted that it is desirable to arrange the rollers so that at least one peak 54 of nut 46 is pressed into a drive roller at any time. This offers an advantage of eliminated a dip in the total frictional force placed on the nut as it rotates. For example, if drive rollers 50 and 52 were simultaneously on a flat surface 56 of nut 46, there would be less friction then when one of points 54 are in contact with one of the drive rollers. In the case of a six sided nut, the drive rollers are arranged so that at least one roller is always in contact with a point 54 by making the angle between lines 58 and 60 90 degrees. It should be noted that it is desirable to have drive rollers made of material having a higher coefficient of friction then the material composing jaws 18 and 22. For example, rollers 50 and 52 may be fabricated using a silicon rubber covered sponge rubber material while jaws 18 and 22 may be TEFLON resin coated. This arrangement permits jaws 18 and 22 to hold nut 46 in a known position while permitting rollers 50 and 52 to rotate nut 46 about it's longitudinal axis in order to thread it upon a receiving threaded member.

Figure 2:
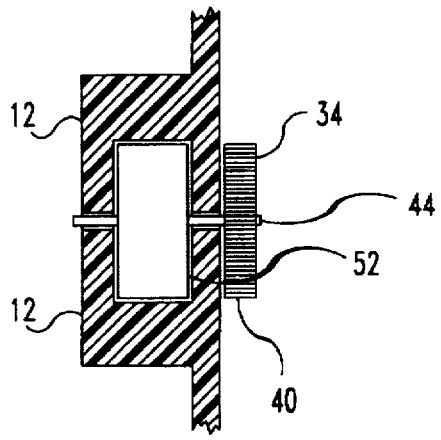
FIG. 2 illustrates a roller assembly.

FIG. 2 illustrates drive roller 52 and gear 34. As mentioned earlier, gear 34 is attached to drive roller 52 so that they both rotate together about pin 44. Pin 44 rotatably connects the assembly to lever arm 12. Lever arm 12 provides bearings for pin 44 on both sides of the drive roller 52 to balance the bearing load. The roller assembly comprising drive roller 50, gear 32 and pin 42 are similar and are rotatably attached to lever arm 10 by pin 42. Drive rollers 50 and 52 may be formed using a sponge rubber material coated with silicon rubber. These types of coated rollers are widely available, for example, they are currently manufactured for the model road racing industry as a slot car tire.

Figure 3:
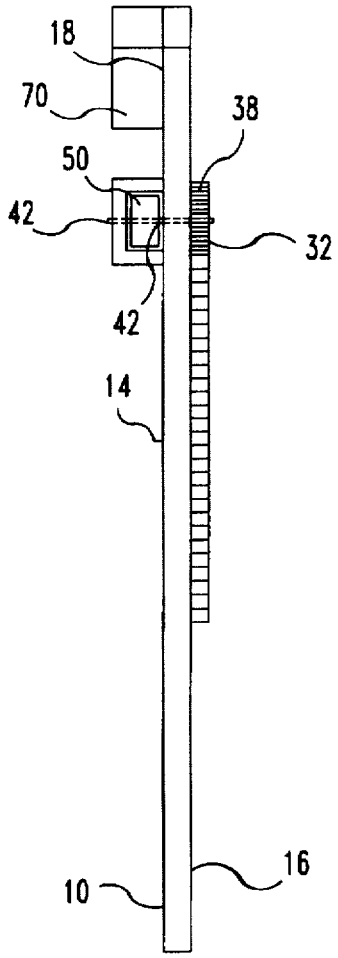
FIG. 3 is a side view of the apparatus of FIG. 1.

FIG. 3 is a side view of lever arm 10 with lever arm 12 removed for clarity. Lever arm 10 is pivotally attached to lever arm 12 (which is not shown) by pin 14. Also attached to pin 14 for rotation about pin 14 is sun gear 30. Teeth 36 of sun gear 30 interact with teeth 38 of gear 32 in order to rotate drive roller 50. Gear 32 and drive roller 50 are rotatably mounted to the jaw end of lever arm 10 by pin 42. Jaw end 18 of lever 10 may be TEFLON resin coated or may include TEFLON resin coated block 70. Lever 12 has a similar TEFLON resin coating or TEFLON resin coated block 70 at jaw end 22. TEFLON resin coated blocks 70 at the jaw ends of the lever arms serve to hold the nut against drive rollers 50 and 52 so that the nut may be rotated by the rollers. Material such as TEFLON resin is chosen for blocks 70 so that the blocks 70 will have a lower coefficient of friction then either of the drive rollers. This permits blocks 70 to hold the nut in position against the drive rollers while permitting the nut to be rotated by the drive rollers.

The present invention was described with regard to placing a nut on top of a threaded bolt; however, the invention is equally applicable to threading a bolt into a nut. The present invention may also be used to assemble other types of threaded parts. For example, electrical connectors, such as F-type coaxial connectors, involve assembling threaded components.

The invention claimed is:

1. An apparatus for assembling a first threaded part having a first longitudinal axis to a second threaded part having a second longitudinal axis, the first and second parts being dimensioned and arranged for threaded mating engagement, the apparatus comprising:

an opposing set of jaws that move between an open position for receiving the first threaded part and a closed position for grasping the first threaded part, the opposing set of jaws moving between the open and closed positions by pivoting about a pivot point;

a drive roller that rotates the first threaded part grasped by the opposing set of jaws about the first longitudinal axis so as to cause the first and second threaded parts to enter into threaded mating engagement; and a roller gear and a drive gear that rotates about the pivot point and drives the roller gear, the drive roller being mounted to the roller gear.

2. The apparatus of claim 1, wherein the drive roller comprises a compliant material.

3. The apparatus of claim 1, wherein the drive roller comprises a first material that contacts the first part and the jaws comprise a second material that contacts the first part, the first material having a higher coefficient of friction than the second material.

4. The apparatus of claim 1, wherein the roller and drive gears are toothed gears.

5. The apparatus of claim 1, wherein the drive gear is larger than the roller gear.

6. An apparatus for assembling a first threaded part having first longitudinal axis to a second threaded part having a second longitudinal axis, the first and second parts being dimensioned and arranged for threaded mating engagement, the apparatus comprising:

an opposing set of jaws that move between an open position for receiving the first threaded part and a closed position for grasping the first threaded part, the opposing set of jaws moving between the open and closed positions by pivoting about a pivot point;

a plurality of drive rollers that rotate the first threaded part grasped by the opposing set of jaws about the first longitudinal axis so as to cause the first and second threaded parts to enter into threaded mating engagement; and a plurality of roller gears and a drive gear that rotates about the pivot point and drives the roller gears, each of the drive rollers being mounted to one of the plurality of roller gears.

7. The apparatus of claim 6, wherein the drive rollers comprise a compliant material.

8. The apparatus of claim 6, wherein the drive rollers comprise a first material that contacts the first part and the jaws comprise a second material that contacts the first part, the first material having a higher coefficient of friction than the second material.

9. The apparatus of claim 6, wherein the roller and drive gears are toothed gears.

10. The apparatus of claim 6, wherein the drive gear is larger than each of the roller gears.

* * * * *